US008312888B2

(12) United States Patent
Rees, Jr.

(10) Patent No.: US 8,312,888 B2
(45) Date of Patent: Nov. 20, 2012

(54) CANOPY ANCHOR PAD SYSTEM

(76) Inventor: Robert Rees, Jr., Cumming, IA (US)

( * ) Notice: Subject to any disclaimer, the term of this patent is extended or adjusted under 35 U.S.C. 154(b) by 170 days.

(21) Appl. No.: 12/534,559

(22) Filed: Aug. 3, 2009

(65) Prior Publication Data

US 2011/0023922 A1 Feb. 3, 2011

(51) Int. Cl.
*E04H 15/58* (2006.01)
*E04H 15/02* (2006.01)

(52) U.S. Cl. ..... 135/117; 135/118; 135/905; 248/508; 248/910; 52/165

(58) Field of Classification Search ..... 135/87, 135/88.06, 97, 121, 144–149, 116–118, 120.1, 135/96, 905; 248/188.8–188.91, 165, 507–508, 248/519, 364.06, 910; 52/2.25, 165
See application file for complete search history.

(56) References Cited

U.S. PATENT DOCUMENTS

| | | | | |
|---|---|---|---|---|
| 165,557 | A | 7/1875 | Geer | |
| 2,521,768 | A | 9/1950 | Adams | |
| 3,474,802 | A | 10/1969 | Loring | |
| 3,655,160 | A * | 4/1972 | Grillot | 248/188.8 |
| 3,965,625 | A | 6/1976 | White | |
| 4,029,117 | A | 6/1977 | Rain | |
| 4,815,736 | A * | 3/1989 | Wright | 473/421 |
| 5,059,463 | A * | 10/1991 | Peters | 428/64.1 |
| 5,092,067 | A * | 3/1992 | Prout | 40/633 |
| 5,241,977 | A * | 9/1993 | Flores et al. | 135/88.06 |
| 5,438,717 | A | 8/1995 | Wells | |
| 5,490,532 | A | 2/1996 | Mallookis et al. | |
| 5,562,288 | A * | 10/1996 | Erkebaev | 273/396 |
| 5,579,797 | A | 12/1996 | Rogers | |
| 5,737,883 | A | 4/1998 | Rose | |
| 5,842,670 | A * | 12/1998 | Nigoghosian | 248/160 |
| 6,089,246 | A * | 7/2000 | Barnes | 135/88.06 |
| 6,308,468 | B1 * | 10/2001 | Caruso | 52/165 |
| 6,370,817 | B1 * | 4/2002 | Brooks et al. | 47/43 |
| 6,401,739 | B1 * | 6/2002 | Bright et al. | 135/98 |
| 6,536,733 | B1 * | 3/2003 | Sharp | 248/519 |
| 6,752,570 | B2 * | 6/2004 | Lanka | 405/272 |
| 6,981,680 | B1 * | 1/2006 | Gordon et al. | 248/346.01 |
| 7,160,214 | B1 * | 1/2007 | Rome | 473/454 |
| 7,168,439 | B2 | 1/2007 | Patel et al. | |
| 7,213,864 | B2 | 5/2007 | Gasper | |
| RE39,842 | E * | 9/2007 | Purvis et al. | 256/67 |
| 7,336,258 | B1 * | 2/2008 | Goetsch et al. | 345/163 |
| 7,374,138 | B2 * | 5/2008 | Marshall | 248/159 |
| 7,380,563 | B2 * | 6/2008 | Seo | 135/145 |
| D578,749 | S * | 10/2008 | Ng et al. | D3/10 |
| 7,530,364 | B2 | 5/2009 | Carter | |

FOREIGN PATENT DOCUMENTS

| | | | |
|---|---|---|---|
| DE | 19834771 | A1 * | 3/1999 |
| EP | 514574 | A1 * | 11/1992 |
| JP | 09242389 | A * | 9/1997 |
| WO | WO 2007083328 | A1 * | 7/2007 |

* cited by examiner

*Primary Examiner* — Winnie Yip
(74) *Attorney, Agent, or Firm* — Zarley Law Firm, P.L.C.

(57) ABSTRACT

A canopy anchor pad system that has a pad with a metal plate attached thereto and a fastening member that extends through the pad. The anchor pad system is attached to the leg of a canopy assembly and is of size and shape to accommodate a secondary weight such as a cooler that can be placed on the pad in order to anchor the leg of the canopy assembly.

9 Claims, 2 Drawing Sheets

CANOPY ANCHOR PAD SYSTEM

BACKGROUND OF THE INVENTION

This invention relates to canopies. More specifically, this invention relates to a canopy anchor pad system.

Portable canopies are utilized in many different applications. This includes tailgating on parking lots, setting up stands, and the like. Difficulties are presented with portable canopies when anchoring the canopies to the ground. Many canopies utilize a stake system used to anchor the canopy to the ground; however, oftentimes canopies need to be set up in areas such as parking lots where such an anchoring system is ineffective or damages the parking lot. Other methods of anchoring a canopy include utilizing bags of sand or similar material and placing them on or around the legs to hold the legs in place. While this helps hold a canopy in place on surfaces such as concrete these bags typically are very heavy, difficult to store and haul and take up much needed room in a vehicle.

Therefore, a principal object of the present invention is to provide a canopy anchoring system that effectively anchors a canopy.

Yet another object of the present invention is to provide a canopy anchoring system that facilitates transporting of the canopy anchor system.

These and other objects, features, and advantages will become apparent from the specification and claims.

BRIEF SUMMARY OF THE INVENTION

A canopy anchor pad system includes a pad that has a metal plate attached thereto and a fastening member that extends through the pad that is removably secured to a leg of a canopy assembly. A secondary weight such as a cooler is placed on the pad to provide additional anchoring force.

DETAILED DESCRIPTION OF THE PREFERRED EMBODIMENT

Figure 1:
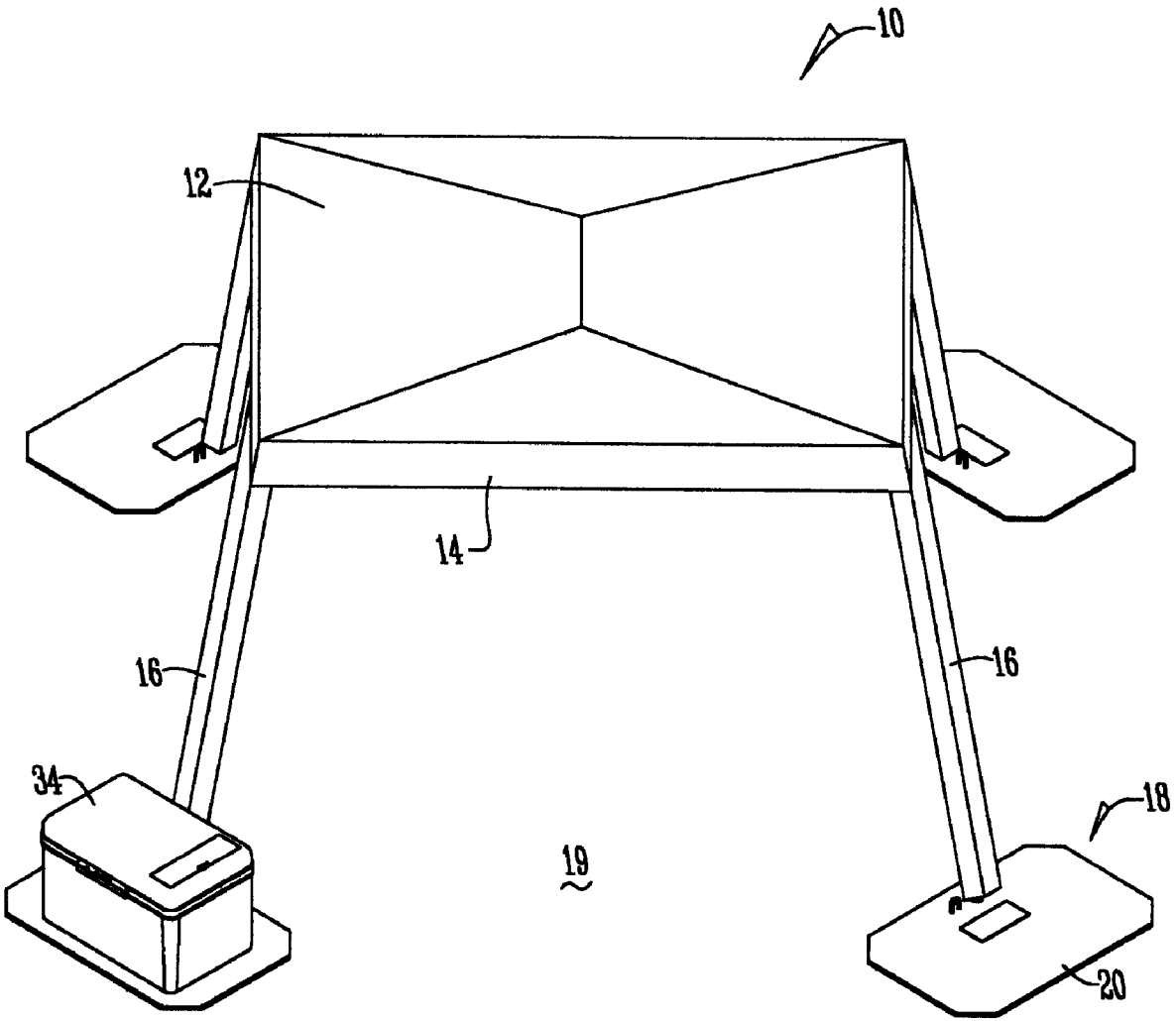
FIG. 1 is a side plan view of a canopy system.
Figure 2:
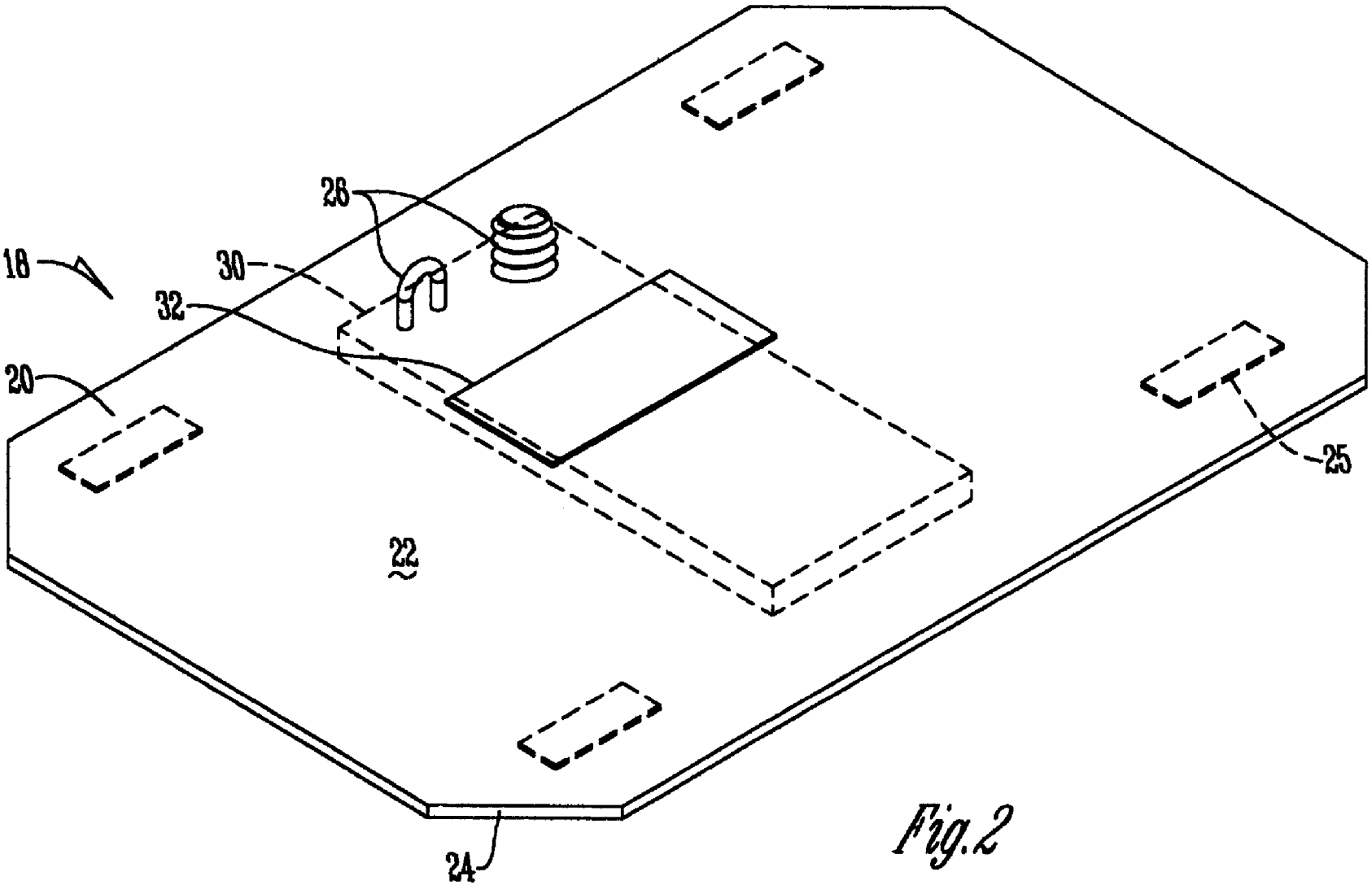
FIG. 2 is a top plan view of a canopy anchor pad system.

FIG. 1 shows a canopy assembly 10 that includes an awning 12 that is held up by a support structure 14. Extending from the support structure 14 and away from the awning 12 are a plurality of legs 16. In one embodiment the plurality of legs are formed from telescoping square tubing that is able to be quickly assembled and disassembled for storage and transportation. Removably attached to each leg is a canopy anchor pad system 18 that anchors the canopy assembly 10 to the ground 19.

The canopy anchor pad system 18 comprises a pad 20 having first and second sides 22 and 24. Preferably, the pad is made of a water resistant material and the second side 24 has a non slip surface or non-slip strips 25 that prevent movement against the ground 19. A fastener 26 extends through the pad 20 and removably secures the canopy anchor pad system 18 to a leg 16. The fastener 26 can be any type of fastener including a bolt, a U-bolt or the like that provides a manner in which the pad 20 can be secured to a leg. Additionally, the fastener 26 may provide a pivotal connection between the leg 18 and pad 20 such as a hook that receives a strap.

The pad 20 has a metal plate 30 attached thereto. The metal plate is preferably 4"×8" or alternatively extends the entire length of the pad 20. The metal plate 30 provides weight in order to anchor the legs 18 of the canopy assembly 10. Additionally, in an embodiment where the fastener 26 is a bolt, the bolt can be welded to the metal plate 30. The pad 20 has a flap 32 that covers the metal plate 30 and fastener 26 to provide safety so that individuals do not catch their shoes, clothing or skin on the fastener 26.

The pad 20 is of size and shape so that a secondary weight 34 such as a cooler can be placed on the pad 20 to provide weight in addition to the metal plate 30. Thus, not only are the legs 16 anchored by the metal plate 30 but in addition the secondary weight 34 provides weight in order to anchor the legs 16. In one embodiment the metal plate 30 extends under the secondary weight 34 so that the secondary weight 34 can be placed on the metal plate 30.

In operation, when a canopy assembly 10 is desired to be used an individual sets up the assembly. In order to anchor the canopy assembly 10 and individual takes the canopy anchor system 18 and secures the system 18 to a leg 16 using a fastener 26. At that time a secondary weight 34 such as a cooler is placed on the pad 20 so that both the metal plate 30 and secondary weight 34 anchor a leg 16.

Thus provided is a canopy anchor pad system 18 that can be used on any surface. In addition, because the system provides an area on which a secondary weight 34 can be placed the amount of room needed to store and transport the system 18 minimized. Thus, at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A canopy anchor pad system comprising:

a canopy assembly supported by a plurality of legs each having an opened lower end;

a plurality of pads each made of water resistant material and each having a metal plate attached thereto;

a fastening member affixed to the metal plate, wherein the fastening member extends upwardly through the pad and is removably secured to the lower end of the leg of the canopy assembly respectively; and a hook member connected to the pad for securing the canopy assembly to the pad; and a secondary weight placed on and engaging the metal plate and the pad such that the metal plate extends from under the secondary weight to the fastening member such that both the metal plate and secondary weight anchor the leg to the pad and to a support surface.

2. The system of claim 1 wherein the secondary weight is placed on the metal plate.

3. The system of claim 1 wherein the secondary weight is a cooler.

4. The system of claim 1 wherein the fastening member is threaded.

5. The system of claim 1 further comprising at least one non-slip member connected to the pad.

6. A method of using a canopy, comprising the steps of:

providing a canopy assembly having a plurality of legs each having an opened lower end;

providing a plurality of pads wherein each pad is sized to receive a cooler;

providing each pad made of water resistant material and with a metal plate attached thereto;

providing each metal plate with a fastening member fixed and extending upwardly thereto;

assembling the canopy assembly;

connecting the pad to each leg by removably securing the fastening member to the opened lower end of the leg respectively; and placing a cooler on the pad and above the metal plate such that the metal plate extends from under the cooler to the fastening member such that both the metal plate and cooler anchor the legs to the pad to additionally secure the canopy assembly to a support surface.

7. The method of claim 6 wherein the plate has a hook member.

8. The method of claim 6 wherein the fastening member is threaded.

9. The method of claim 6 wherein each pad is pivotably connected to each leg.

* * * * *